United States Patent [19]

Frost

[11] Patent Number: 4,487,156

[45] Date of Patent: Dec. 11, 1984

[54] BOOKMARK

[76] Inventor: Barry J. Frost, Clematis Cottage, Boreham La., Boreham St., Nr. Hailsham, E. Sussex., England

[21] Appl. No.: 361,991

[22] Filed: Mar. 25, 1982

[30] Foreign Application Priority Data

Mar. 25, 1981 [GB] United Kingdom ..... 8109273
Jun. 2, 1981 [GB] United Kingdom ..... 8116811

[51] Int. Cl.[3] ..... B42D 9/00

[52] U.S. Cl. ..... 116/239; 116/237; 116/234; 281/42; 281/45

[58] Field of Search ..... 281/42, 45; 116/234, 116/237, 238, 239

[56] References Cited

U.S. PATENT DOCUMENTS

| | | | |
|---|---|---|---|
| 461,341 | 10/1891 | Johnson | 281/42 |
| 528,560 | 11/1894 | Pendleton | 281/42 |
| 1,067,927 | 7/1913 | Knowles | 281/42 |
| 1,646,291 | 10/1927 | Horacek | 281/42 |
| 1,862,573 | 6/1932 | Grosz | 281/42 |
| 1,937,442 | 11/1933 | Scognamillo | 281/42 |
| 2,136,326 | 11/1938 | Spandorfer | 281/42 |
| 2,449,211 | 9/1948 | Forsyth | 116/239 X |
| 2,606,042 | 8/1952 | Freber | 281/42 |
| 2,610,074 | 9/1952 | Meyers | 281/42 |
| 3,090,347 | 5/1963 | Harnett, Jr. | 281/42 X |
| 3,158,131 | 11/1964 | Salayka | 281/42 |
| 3,159,137 | 12/1964 | Baldwin | 281/42 |
| 3,661,405 | 5/1972 | Brown | 281/42 |
| 4,285,532 | 8/1981 | Davis | 281/42 |

FOREIGN PATENT DOCUMENTS

| | | | |
|---|---|---|---|
| 0023083 | of 1898 | United Kingdom | 281/42 |
| 0017167 | of 1903 | United Kingdom | 116/234 |
| 0007312 | of 1903 | United Kingdom | 281/42 |
| 1032569 | 6/1966 | United Kingdom | 281/42 |

*Primary Examiner*—Paul A. Bell
*Attorney, Agent, or Firm*—William A. Drucker

[57] ABSTRACT

A bookmark, comprising an anchoring member 1, 2 for securing the bookmark to the cover of a book, and a pointer 3 connected to the anchoring member and adapted in use to overlie an edge portion of pages of the book, and extending generally in the direction of a center portion of the spine of the book, the arrangement being such that the pointer is capable in use of flexing outwardly of the pages of the book on turning of a page, to allow passage of the page past the pointer. The outermost end of arm 4 carries a small stop 6 which is positioned to bear on the top edge of the book cover when used with a hard-backed book. This urges the outer end of arm 4 upwardly, and thus the pointer 3 downwardly, to compensate for the fact that the pages of a hard-backed book are generally lower than the cover.

5 Claims, 12 Drawing Figures

BOOKMARK

This invention relates to bookmarks, and in particular to bookmarks which are affixed to a rear cover of the book in question.

One type of bookmark of this kind is described in British patent specification No. 1032569. The bookmark described in that specification includes a clip adapted to be fixed to the rear cover of a book, and an indicator element or pointer extending from the clip outwardly of the spine of the book, which serves to keep the place of the reader. The pointer extends generally in the direction of the centre of the outer edges of the pages, and furthermore, the indicator element or pointer has no flexibility in the direction outwardly of the pages of the book. For this reason, each time a page is turned, it is necessary to manipulate the page around the pointer, i.e., the pages cannot be turned in the usual way, but instead each page must be slid from beneath the pointer before it can be turned.

In contrast, when the bookmark according to this invention is utilised it is not necessary to slide the pages from beneath a pointer, but instead they may be turned in the normal way and thus the bookmark can be virtually ignored. The pointer does not need to be moved manually each time a page of the book is turned, but retains the place of the reader in the book without the need for any attention by the reader.

According to the present invention there is provided a bookmark, comprising an anchoring member for securing the bookmark to the body of a book, preferably to the rear cover of the book, and a pointer connected to the anchoring member and adapted in use to overlie an edge portion of pages of the book, and to extend from the anchoring member generally in the direction of a centre portion of the spine of the book, the arrangement being such, as that used, the pointer is capable in use of flexing outwardly of the pages of the book on turning of a page, to allow passage of the page past the pointer. The term "rear cover" as used herein is intended to mean that cover of the book most nearly adjacent the pages of the book intended to be read last by the reader.

Because in the bookmark of the present invention, the pointer extends generally in the direction of the centre portion of the spine of the book, and the pointer is capable of flexing outwardly of the page of the book, a normal turning movement of a page will cause the pointer to be displaced outwardly, to allow the page to pass, without the need to take care to slide the page from beneath the pointer. Thus, in use, the bookmark can be virtually ignored, and the book read in the normal way, and yet the reader's place is maintained by the pointer.

The anchoring member preferably takes the form of a clip for securing the bookmark to the rear cover of the book, although in an alternative embodiment, the anchoring member may be affixed permanently to the rear cover of the book, for example by adhesive.

In a further alternative embodiment, the anchoring member may take the form of a wedge-like member adapted for reception in a corresponding groove, for example a dovetail groove, formed on the cover of the book, or of a press-stud or the like adapted for co-operation with a corresponding member on the book cover.

In yet a further alternative embodiment, the anchoring member may take the form of a loose protective jacket adapted to fit over the book cover, and incorporating a pointer as setforth above integrally therewith.

In addition to being provided as an accessory for an existing book as setforth above, by the incorporation of an anchoring member for securing the device to a book cover, a bookmark according to the invention may be incorporated permanently into a book, for example forming a pointer as described above integrally with a cover of the book.

Accordingly, in a second aspect of the invention there is provided a book, incorporating a bookmark attached to the book cover, the bookmark including a pointer adapted in use to overlie an edge portion of pages of the book, and extending over the said edge portion generally in the direction of a centre portion of the spine of the book, the arrangement being such that, in use, the pointer is capable of flexing outwardly of the pages of the book on turning of a page, to allow passage of the page past the pointer.

The bookmark preferably includes an arm which extends from the anchoring member generally outwardly of the spine of the book, and the second arm, connected at one end to the outward end of the first arm, and at its other end to the pointer. This arrangement gives the desired degree of flexibility to the pointer, so that it is capable of flexing not only outwardly of the pages of the book, but also in the direction perpendicular to the plane of the book, whereby the pointer retains light pressure on the book page, no matter where in the book the finger lies. The first and second arm may be continuous, the transition between them being marked only by a change of direction.

The bookmark may preferably be formed as an integral moulding, for example in nylon.

A preferred embodiment of the invention will now be described with reference to the accompanying drawings, in which.

Figure 5:
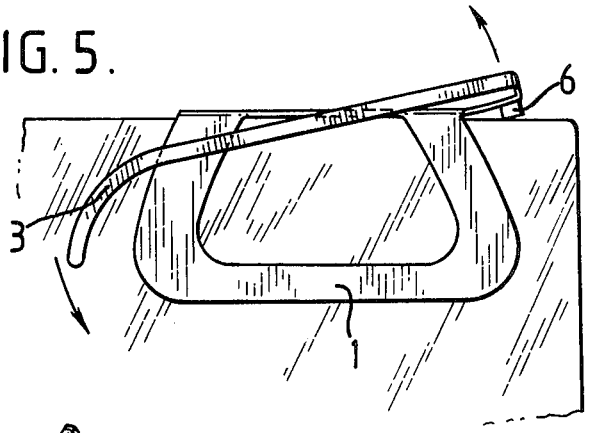
Figure 6:
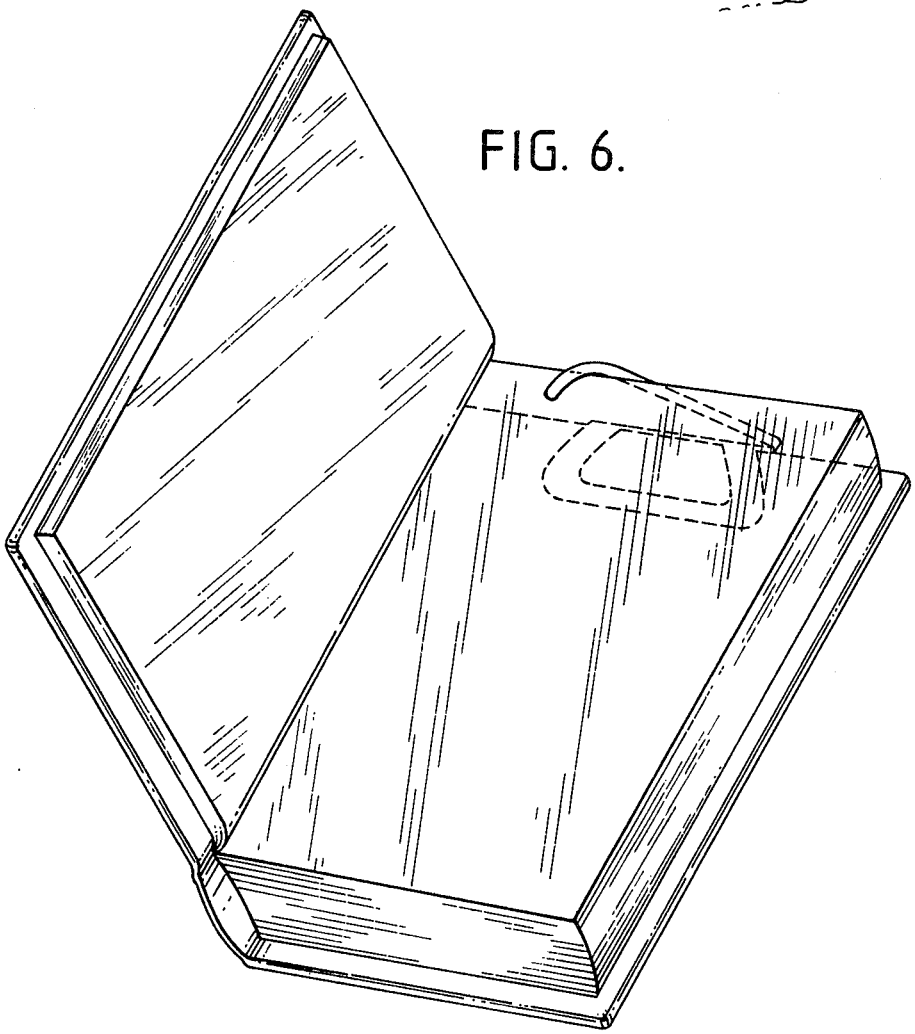
Figure 7:
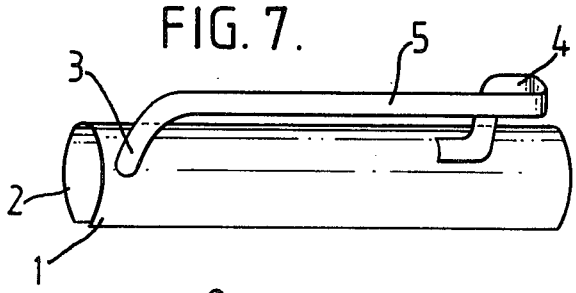
Figure 8:
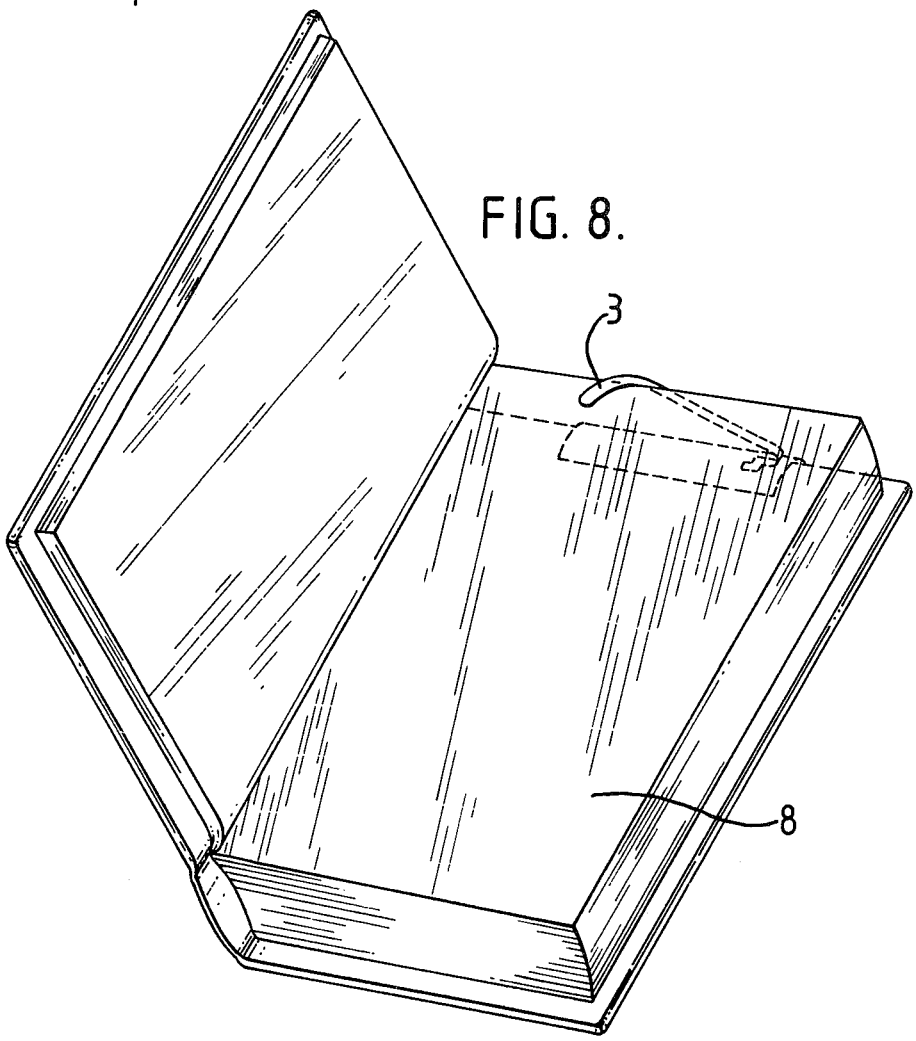
Figure 9:
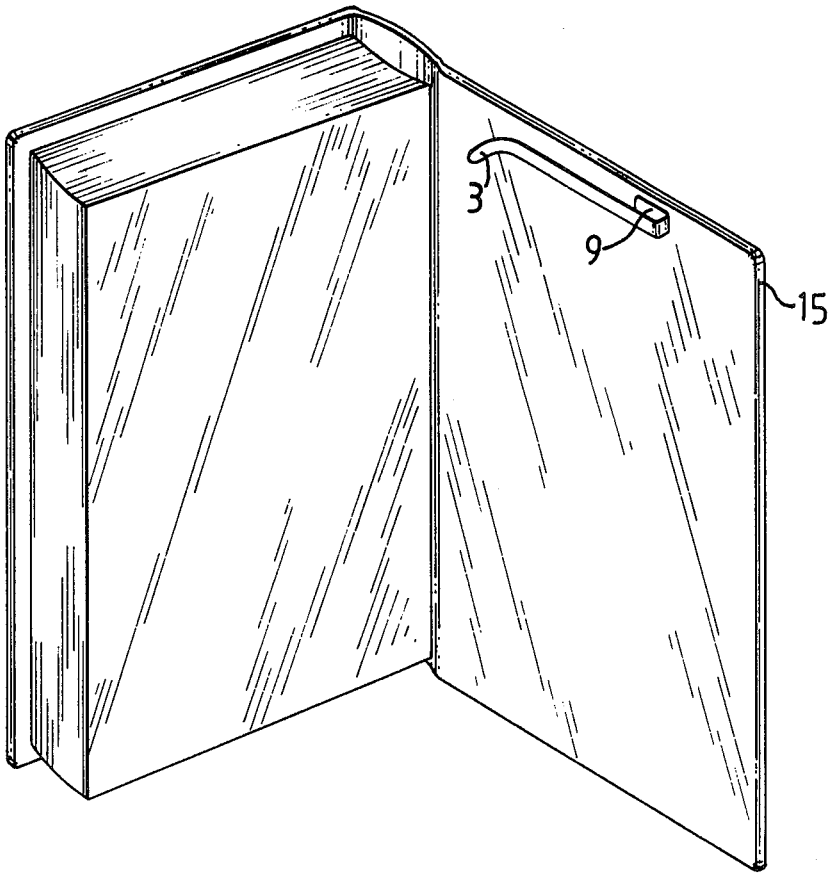

FIG. 5 shows the same bookmark clipped to the rear cover of a hard-backed book, FIG. 6 illustrates the same bookmark in use, FIG. 7 is a front view of an alternative embodiment of the bookmark of the invention, FIG. 8 illustrates the bookmark of FIG. 7 in use on a hard-backed book, FIG. 9 shows a bookmark according to a further embodiment of the invention, permanently affixed to the rear cover of a book.

Figure 10:
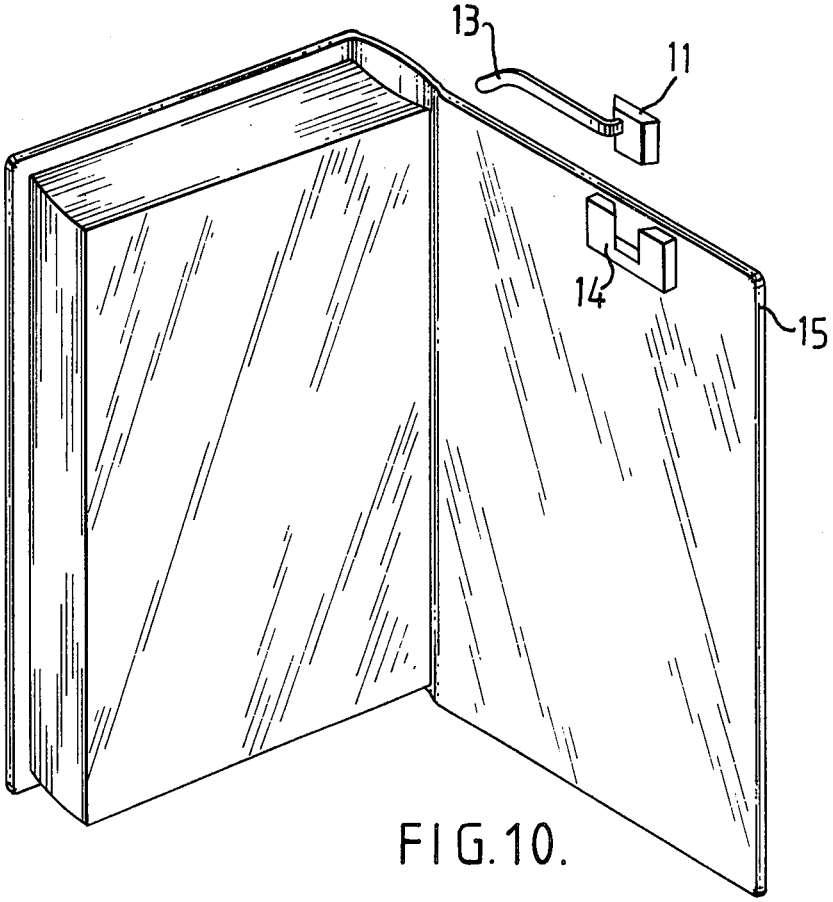
Figure 11:
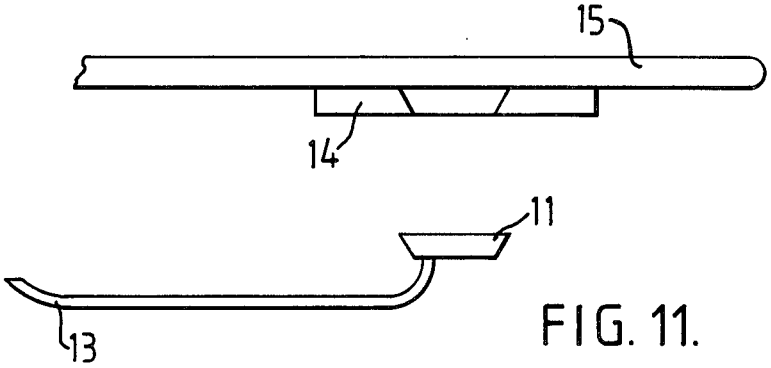
Figure 12:
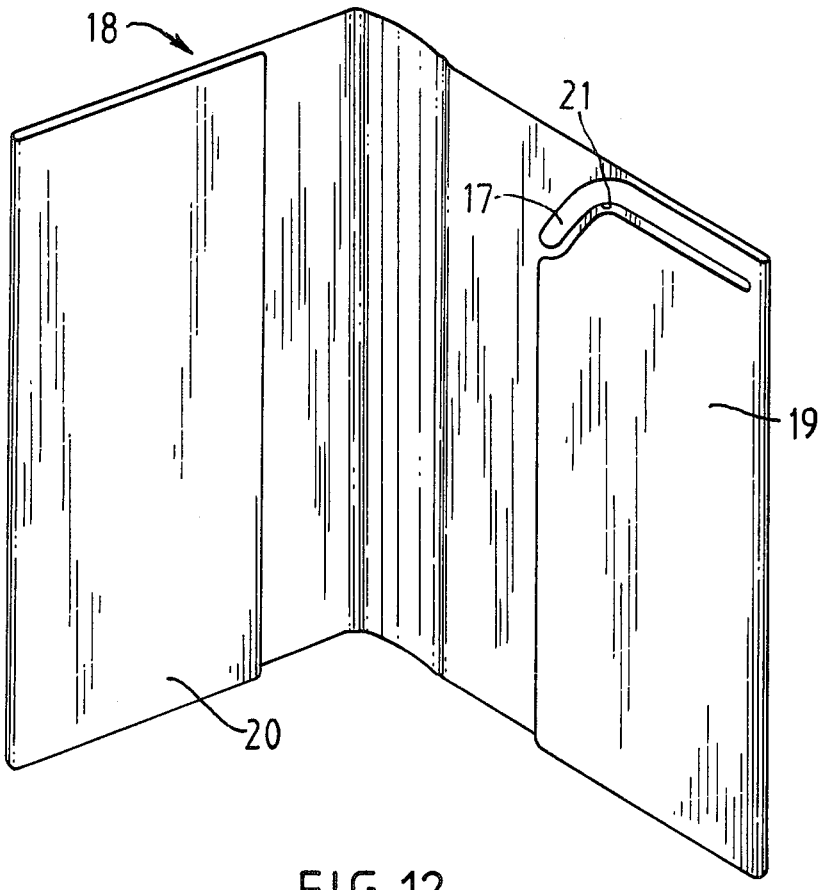

FIGS. 10 and 11 are a perspective and plan view respectively of a further embodiment of the invention, and FIG. 12 shows yet a further embodiment of the invention.

Figure 1:
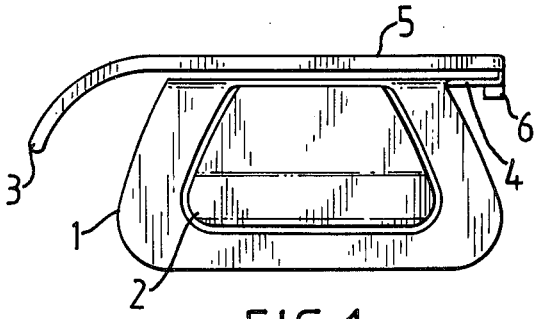
FIG. 1 is a front view of a bookmark according to the invention.
Figure 2:
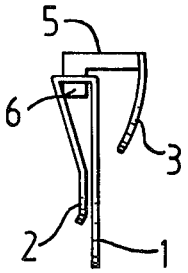
FIG. 2 is a side view of the bookmark of FIG. 1.
Figure 3:
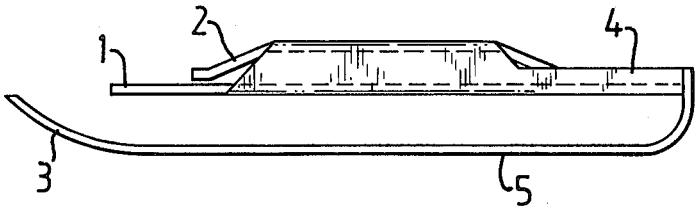
FIG. 3 is a plan view of the bookmark of FIG. 1.
Figure 4:
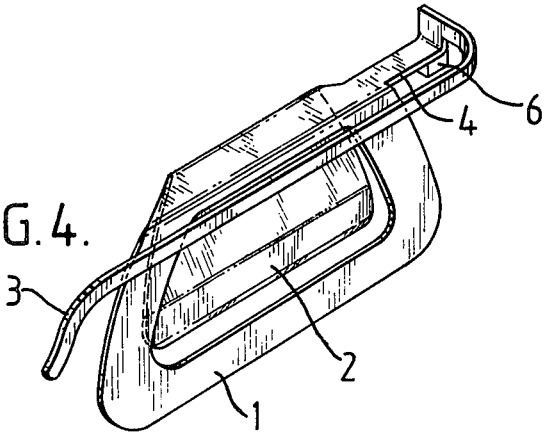
FIG. 4 is a perspective view of the bookmark of FIG. 1.

Referring to FIGS. 1 to 6, the bookmark has an anchoring member in the form of a U-shaped clip constituted by limbs 1 and 2. The base of the "U" carries an arm 4, which extends in use generally outwardly of the pages of the book, i.e., away from the spine. To the outward end of the arm 4 is connected a second arm 5, which curves back towards the spine of the book, and carries at its inward end a pointer 3. The pointer 3 extends downwardly and inwardly (i.e. is directed generally in the direction of the centre of the spine of the book) and is curved both downwardly of the pages of the book (as shown in FIG. 1) and rearwardly of the book (as shown in FIG. 3). The provision of the two arms 4 and 5 makes it possible for the pointer 3 to flex not only perpendicular to the plane of the book, so as to retain gentle pressure on the page indicated at all times, but also outwardly of the pages of the book. Because the pointer 3 extends generally in the direction of the centre of the spine of the book, (i.e. inwardly and downwardly), if the top outer corner of a page is grasped in the normal way, and the page turned, the pointer 3 will be moved by the page, without the need to slide the page beneath the pointer as can be seen from FIG. 6.

The outer most end of arm 4 carries a small stop 6 which, shown in FIG. 5, is so positioned as to bear on the top edge of the book cover, when the bookmark is used with a hard-backed book. This has the effect of urging the outer end of arm 4 upwardly, and thus the pointer downwardly, to provide some compensation for the fact that the pages of a hard-backed book are generally lower than the cover. The thinner covers used with paper-backed books will not interfere with the block 6 however and the pointer will thus not be depressed in this case. Thus, the presence of the block allows the bookmark to adapt itself automatically to paper-back or hard-backed books.

The downward curve of the pointer 3 is advantageous in allowing the pointer to curve over the edge of the book or pages close to the beginning. The pointer is preferably made of a flexible material, so that closure of the book readily flattens the curved portion without damage to the book.

FIGS. 7 and 8 illustrate an alternative embodiment of the bookmark, essentially similarly in function to that illustrated in FIGS. 1 to 6, like reference numerals being used to designate like parts. In this embodiment, the first arm 4 is shorter, and forms together with second arm 5 and pointer 3 a separate integral unit which is fixed to the clip formed by limbs 1 and 2.

In the embodiment shown in FIG. 9, the anchoring member takes the form of a flat portion 9, which is permanently affixed to the rear cover of the book by an adhesive, or by being incorporated into the binding. The bookmark may be incorporated into the book at the time of manufacture, or affixed at a later stage by means such as adhesive or adhesive tape.

FIGS. 10 and 11 illustrate a further alternative embodiment in which the anchoring member takes the form of a dovetailed retaining block 11, having a pointer 13 attached thereto. The pointer 13 may be formed integrally with the block 11 as a one-piece flexible plastic moulding, or may be otherwise affixed thereto, for example with an adhesive. The dovetailed retaining block 11 is adapted for reception in a holder 14 which, as can be seen in FIG. 10 is generally 'U' shaped, the side walls of the 'U' being corresponding dovetailed to accommodate the dovetailed block 7. The holder 14 is permanently affixed to the rear cover of a block 15, for example by means of an adhesive, such that the block 11 may be removably accommodated in holder 14. In use, pointer 13 is able to flex outwardly of the pages on turning of a page and functions generally as described above with reference to pointer 3 in FIGS. 1 to 6.

In the embodiment shown in FIG. 12, a pointer 17 is formed as a part of a jacket 18 for the book cover. The jacket 18 is formed of a suitably flexible plastics material, the pointer 17 being formed therefrom by a simple stamping operation. In this case the whole of the jacket 18 serves as an anchoring member for anchoring the pointer to the book cover. In use, the flaps 19 and 20 of the jacket are caused to lie adjacent the inner face of the book cover in a conventional manner, the pointer 17 being caused to overlie an edge portion of pages of the book, and to function generally as pointer 3 in FIGS. 1 to 6 as described above. As in the embodiments shown in FIGS. 7 to 11, the pointer extends generally in the direction of a centre portion of the spine of the book, and the inner edge 21 of the pointer arm 17 is curved so as to assist passage of pages past the pointer on turning of a page.

It should of course be understood that the invention is not limited to the foregoing specific embodiments, and various other configurations are possible, within the scope of the appended claims. For example, the parts 1 or 2 of the clip may be extended so as to provide space for advertising indicia or the like material. It should be understood furthermore that the term "the cover" as used herein includes the spine of the book, and in certain circumstances it may be advantageous to anchor the pointer only to the spine portion of the cover.

I claim:

1. A bookmark for use in combination with a book having a cover and a back, comprising, (a) an anchoring member for securing the bookmark to said cover of said book, (b) a first arm arranged to extend in use from the anchoring member generally outwardly of said cover of said book, (c) a second arm having a first end connected to the outward end of the first arm and arranged in use to extend generally inwardly of said cover to said book and terminating at a second end, (d) a pointer extending from the second end of the second arm at an acute angle to the second arm so as, in use, to extend generally towards a center, inner portion of said book cover, the arrangement being such that the pointer is capable in use of flexing outwardly of the pages of said book on turning a page to allow passage of the page past the pointer, (e) wherein the first arm includes a stop positioned so that when the bookmark is used with a hard back book, said stop rests against the outer edge of said book cover to urge the outer end of the first arm outwardly of the pages of said book, thereby to urge the pointer inwardly of the pages of said book.

2. A bookmark as claimed in claim 1, wherein said book has a rear cover and wherein the anchoring member comprises a clip for securing the bookmark to an edge of the rear cover of the book.

3. A bookmark as claimed in claim 1, wherein the pointer is curved towards the back of the book.

4. A bookmark as claimed in claim 3, wherein the pointer is flexible, whereby closure of the book on the pointer causes substantial flattening of the said curve.

5. A bookmark as claimed in claim 1 wherein each of the elements is in the form of an integral moulding.

* * * * *